US005657704A

United States Patent [19]

Schueler

[11] Patent Number: 5,657,704

[45] Date of Patent: Aug. 19, 1997

[54] CONTINUOUS HIGH PRESSURE SOLIDS PUMP SYSTEM

[75] Inventor: Peter H. Schueler, Richfield Village, Ohio

[73] Assignee: The Babcock & Wilcox Company, New Orleans, La.

[21] Appl. No.: 589,986

[22] Filed: Jan. 23, 1996

[51] Int. Cl.[6] ..... F23K 1/00

[52] U.S. Cl. ..... 110/106; 110/101 R; 222/1; 406/197

[58] Field of Search ..... 110/101 R, 106, 110/101 C, 101 CC, 101 CD, 101 CF, 245; 406/23, 24, 120, 99, 197, 10, 12; 222/1, 630, 637, 196, 195; 198/617, 642, 723; 34/359, 360

[56] References Cited

U.S. PATENT DOCUMENTS

| | | | |
|---|---|---|---|
| 3,101,909 | 8/1963 | King | 241/25 |
| 3,689,045 | 9/1972 | Coulter et al. | 266/28 |
| 3,720,351 | 3/1973 | Coulter et al. | 222/1 |
| 3,764,236 | 10/1973 | Carter | 417/372 |
| 3,817,652 | 6/1974 | Fuller | 415/97 X |
| 3,963,415 | 6/1976 | Albright | 432/14 |
| 3,975,058 | 8/1976 | York | 406/60 |
| 4,025,121 | 5/1977 | Kleysteuber | 406/96 |
| 4,152,029 | 5/1979 | Cowpertwait | 406/38 |
| 4,180,353 | 12/1979 | Geidies | 406/74 |
| 4,207,081 | 6/1980 | Preusser et al. | 48/210 |
| 4,352,570 | 10/1982 | Firth | 366/127 |
| 4,353,558 | 10/1982 | Firth | 277/30 |
| 4,361,333 | 11/1982 | Firth | 277/12 |
| 4,391,561 | 7/1983 | Smith et al. | 414/218 |
| 4,392,438 | 7/1983 | Dooley | 110/106 |
| 4,516,674 | 5/1985 | Firth | 198/617 |
| 4,564,297 | 1/1986 | Firth | 366/108 |
| 4,650,342 | 3/1987 | Goodwin | 366/264 |
| 4,758,118 | 7/1988 | Rachner et al. | 406/24 |
| 4,936,744 | 6/1990 | Dosch et al. | 415/169.1 |
| 4,974,998 | 12/1990 | Heineman | 406/97 |
| 4,988,239 | 1/1991 | Firth | 406/99 |
| 5,051,041 | 9/1991 | Firth | 406/99 |
| 5,175,943 | 1/1993 | Eastham et al. | 110/106 X |

(List continued on next page.)

OTHER PUBLICATIONS

Carmichael, I.F. article, entitled "An Introduction to Blast Furnace Coal Injection". Mar. 1992 edition of *Iron and Steelmaker.* pp. 67–73.

Sexton, J.R. & Wennerstrom, J.M technical paper presented to Association of Iron and Steel Engineers, Chicago, IL in Sep. 1982, entitled "Blast Furnace Coal Injection: Long Proven, Now Economical". Entire paper.

Stamet, Inc. Brochure, "Revolutionary Solids Feeding & Metering Systems", Gardena, CA. Date Unknown. Four pages.

Stamet, Inc. Brochure, "High Pressure Feeding", Gardena, CA. Date Unknown. Two pages.

Stamet, Inc. Brochure, "Coal Handling Problems?", Gardena, CA. Date Unknown. Two pages.

Stamet, Inc. Brochure, "Programmable Logic Controller", Gardena, CA. Date Unknown. Two pages.

Stamet, Inc. paper by Black, R.L., Brat, J., and Saunders, T.W., "Enhanced Mill and Boiler Performance and Improved Emissions Control Through Continuous, Accurately Metered Coal Delivery". Presented at Power–Gen, 1994, Orlando, FL on Dec. 8, 1994. Seventeen pages.

Brat, J., "EPRI Coal Feeder Test". Prepared for Pennsylvania Power & Light Company Sunbury Steam Electric Station. Interim Report. May 13, 1994. Entire paper. Text only, without appendices; nine pages.

*Primary Examiner*—Kevin P. Shaver

*Attorney, Agent, or Firm*—Robert J. Edwards; Eric Marich

[57] ABSTRACT

A system and method for continuously supplying solids from a lower pressure storage reservoir to a high pressure feeder tank for use in an application such as a blast furnace employs a high pressure variable speed solids pump. A fluidizing device discharges solids in a dense phase flow to a deaerating device for deaerating the solids flow prior to entering a variable speed high pressure solids pump. A feeder tank having an outlet is connected to the outlet of the solids pump and the feeder tank is at a higher pressure than the source of the solids.

19 Claims, 6 Drawing Sheets

U.S. PATENT DOCUMENTS

| | | | |
|---|---|---|---|
| 5,223,199 | 6/1993 | Ponzielli | 264/114 |
| 5,265,983 | 11/1993 | Wennerstrom et al. | 406/24 |
| 5,285,735 | 2/1994 | Motoi et al. | 110/101 CB |
| 5,325,603 | 7/1994 | Eastham et al. | 34/371 |
| 5,355,993 | 10/1994 | Hay | 198/642 |
| 5,356,280 | 10/1994 | Ponzielli | 425/201 |
| 5,381,886 | 1/1995 | Hay | 198/642 |
| 5,400,725 | 3/1995 | Brännström | 110/245 |
| 5,402,876 | 4/1995 | Hay | 198/638 |
| 5,485,909 | 1/1996 | Hay | 198/642 |
| 5,496,150 | 3/1996 | Claxton, III et al. | 415/229 |
| 5,497,873 | 3/1996 | Hay | 198/642 |
| 5,533,650 | 7/1996 | Conrad et al. | 222/161 |
| 5,551,553 | 9/1996 | Hay | 198/624 |
| 5,560,550 | 10/1996 | Krawczyk | 241/19 |

CONTINUOUS HIGH PRESSURE SOLIDS PUMP SYSTEM

FIELD AND BACKGROUND OF THE INVENTION

The present invention relates in general to pulverized fuel delivery systems such as pulverized coal injection (PCI) systems for blast furnaces used in iron and steel production, and in particular to a new and unique pulverized fuel delivery system and method which uses a high pressure, variable speed solids pump for continuously providing pulverized coal to one or more blast furnaces or other users of pulverized coal.

The use of pulverized coal as a fuel for blast furnaces was first introduced approximately 35 years ago, and is a popular fuel due to its relatively low cost and widespread availability. Several different delivery systems for conveying the pulverized coal to furnaces or other combustion applications have been developed. In particular, one modern group of substantially continuous flow, high pressure pulverized coal pneumatic delivery systems is characterized by the use of atmospheric reservoirs to fill pressurized feeder tanks, which in turn supply pulverized coal to multiple injection lines or to a feed line connected to one or more distributors. The distributors convey the pulverized coal from the feed line to multiple points in a furnace or other application. The coal may be provided in what is known as "dense phase" because of the relatively high ratio of solids to volume of gas present, or it may be conveyed in dilute phase depending on the specific technology employed.

However, these known methods for continuously delivering pulverized coal fuel to blast furnaces for burning all have drawbacks, such as inefficient use of materials, space, or energy. These problems arise primarily from the difficulty of moving the pulverized coal from atmospheric pressure storage bins to higher pressure feeder or batch tanks for injection into a furnace. Also, because the pulverized coal is provided in the dense phase at high pressure, rotary feeders do not work well due to pressure limitations.

U.S. Pat. Nos. 3,689,045 and 3,720,351 to Coulter et al. both disclose a pulverized coal delivery system for providing dense phase pulverized coal to a blast furnace. An atmospheric coal grinding and collection system is combined with two or more pressurized batch or feeder tanks, preferably at least three separate feeder tanks, which are connected to one storage reservoir. While one full feeder tank is used to supply the pulverized coal to the blast furnace at high pressure, the remaining two feeder tanks may be refilled from the storage reservoir at atmospheric pressure. Once a feeder tank is filled, it is pressurized and readied to be placed online when the supply of pulverized coal in that feeder tank currently feeding the blast furnace is depleted, thus maintaining a substantially continuous pulverized coal fuel flow into the blast furnace. This cycle is continuously repeated, such that one feeder tank is always online and feeding the blast furnace, while the remaining two feeder tanks are at varying stages of refilling with pulverized coal and/or recharging to high pressure.

More particularly, the pulverized fuel delivery systems of Coulter et al. operate such that each batch tank in these systems is cycled continuously in the following sequence:

a. At atmospheric pressure (vented), the feeder tank is filled by gravity flow from a pulverized fuel reservoir located above through a connecting pipeline.

b. Once filled, a valve in the fill pipeline is closed and the feeder tank is pressurized with inert gas.

c. Once pressurized, the feeder tank is in the ready condition and remains in standby until the on-line feeder tank is empty.

d. When the time comes for the ready tank to go on-line, e.g., to begin feeding pulverized fuel to the blast furnace, a valve in the discharge line located below the tank opens and pulverized fuel in dense phase flows out under pressure into the fuel transport and distribution system which connects the tank to the furnace.

e. Once the tank is nearly empty, the pulverized fuel discharge valve closes and the feeder tank pressure is vented down to atmospheric pressure. This completes the cycle which generally requires a time span of 30 to 90 minutes.

Another common form of high pressure solids feed system employs two tanks in series, and is shown in schematically in FIG. 1. The first tank, commonly referred to as a lock hopper, receives solids materials from an atmospheric storage reservoir by gravity flow. This first tank is then closed and pressurized to a pressure equal to the pressure of the second or feed tank. A drain valve in the first tank is opened to release the material into the feed tank. Once the first tank is emptied, it is depressurized and refilled for another cycle.

Other known methods for continuously transporting fine solids in dense phase include the cascading pressure continuous blow bottle disclosed by U.S. Pat. No. 5,265,983 to Wennerstrom et al. The Wennerstrom et al. patent provides for the continuous filling of a blow bottle, which takes the place of multiple feeder tanks. This device employs a single variable speed rotary feeder in combination with one or more constant speed rotary feeders in a cascade arrangement. The upper variable speed rotary feeder is capable of handling 20 psig differential pressure, while the lower constant speed feeders are designed for higher differential pressures up to 50 psig. Continuous venting of the rotary feeders is necessary to prevent up-draft of gas through the feed system. In a high pressure system, the continuous venting of the feeders will result in a large quantity of compressed gas (typically nitrogen or $N_2$) being lost, and this wasted nitrogen is a costly element in the overall system.

U.S. Pat. No. 4,392,438 to Dooley discloses a coal transport system for delivering a pulverized coal fuel from a remote point directly to a furnace or alternately to a storage chamber. The system disclosed in the '438 patent uses coal gas to pressurize the system and force the pressurized coal from a processing and pulverizing plant through a pipeline having a series of booster stations used to maintain pressure to a furnace. The system of the '438 Dooley patent is similar in concept to that of the present invention, however it does not use a high pressure variable speed solids pump to maintain and initiate the fuel flow into the furnace, nor does it concern itself with filling and maintaining a fuel level in a feeder tank.

U.S. Pat. No. 5,285,735 to Motoi et al. discloses a control apparatus for injection of a particular quantity of pulverized coal into a blast furnace. This patent does not disclose the use of a high pressure variable speed solids pump either, but merely a different means of controlling the level of coal in a feed tank for supplying the furnace. The Motoi et al. patent uses additional pressurizing gas to maintain the pressure within the feed tank while varying the rate at which the feed tank is filed with the control system. The Motoi et al. patent's apparatus uses a conveying gas in conjunction with a pressurized gas and a series of valves to achieve similar results as are achieved with the high pressure pump of the present invention which requires much less equipment.

It is thus apparent that an improved pulverized fuel delivery system that can reduce or eliminate: the cycling of multiple batch tanks, the disruptions that occur when one such batch tank is taken off line and another is started, and the venting of significant quantities of pressurizing gas, would be welcomed by the industry.

SUMMARY OF THE INVENTION

It is a primary object of this invention to improve upon and streamline the process of continuously providing atmospheric pressure pulverized coal to a high pressure solids feeder tank for supplying a blast furnace or other application.

Accordingly, a system is provided in which solids, such as pulverized coal, are provided to and stored at atmospheric pressure in a reservoir, from where the solids are discharged by gravity in dense phase flow and continuously conveyed to a high pressure feeder tank through a variable speed, high pressure solids pump, preferably of the type disclosed in U.S. Pat. Nos. 4,516,674; 4,988,239; and 5,051,041 to Firth. However, in most instances it is envisioned that deaeration means will have to be provided just upstream of the solids pump to maintain proper inlet conditions so that the pump will operate properly. The high pressure feeder tank may be connected to a blast furnace or other application which requires a continuous supply of solids, such as pulverized coal, through a dense phase discharge line. In some systems the dense phase discharge may be diluted with the addition of gas for improved flow characteristics.

The high pressure solids pump both meters the flow of solids into the feeder tank and increases the pressure from atmospheric pressure. This system for filling the high pressure feeder tank may be operated continuously and the speed of the pump may be controlled so that a nearly constant level of solids may be maintained in the feeder tank. Preferably, the pump will be capable of providing solids to the feeder tank at least as rapidly as the solids are discharged from the tank outlet for use. As a result, this system eliminates the need for more than one high pressure feeder tank for each application which it is supplying with solids.

The reservoir may have fluidizing gas added near the outlet to facilitate the dense phase flow of solids into the pump. Additional fluidizing gas may also be provided to the outlet of the feeder tank, in order to maintain the dense phase flow through the discharge line and assist in regulating the discharge flow. Pressurizing gas is added to the feeder tanks to further assist the regulation of the discharge flow and maintain the pressure in the feeder tank to the required process pressure which may normally range from 5 to 20 atmospheres, although other pressures may be maintained depending on the application.

Valves may be added at one or more points between the reservoir and feeder tank to assist in depressurizing and isolating parts of the system for cleaning and maintenance purposes. Further, vents may be provided on the feeder tank for assisting with the pressure adjustment of the tank and helping to regulate the flow out of the feeder tank while operating.

In one application of the present invention, additional solids pumps may be added in parallel with the first pump to supply the same tank or other feeder tanks from the same reservoir. The different pumps and feeder tanks do not have to have the same capacity requirements and their fill levels may be maintained independently of each other, although they may have identical characteristics. The additional feeder tanks may be modified existing feeder tanks from the known two or three feed tank supply systems described above, thus utilizing existing equipment and avoiding large costs to implement the system of the present invention.

The process of the present invention requires providing solids to a reservoir maintained at atmospheric pressure, passing the solids to a variable speed, high pressure solids pump, using the pump to pressurize the solids and convey the solids to a pressurized feeder tank. The solids may then be supplied to an application such as a blast furnace by conveying the solids from the feeder tank through a discharge line or other apparatus.

The new system and process of the invention is advantageous for many reasons. The use of a continuous pump supplying one feeder tank eliminates the need for more than one feeder tank, or for a lock hopper transfer tank and as a result, eliminates the venting of significant quantifies of pressurized gas which occurs in known systems when individual batch feeder tanks or lock hoppers are depressurized. It also eliminates the disruption in the feed system which occurs when switching between batch tanks.

Advantages over other systems include the elimination of the need to continually vent the system to prevent blow-back of solids since the pump helps to generate the pressure. And, because the solids pump is capable of providing higher pressure levels independently, the need for a series of pumps to pressurize and convey the solids is eliminated.

Accordingly, one aspect of the present invention is drawn to a continuous high pressure solids supply system which comprises a source of solids, and a dense phase discharge conduit for conveying the solids in a dense phase flow. This discharge conduit will preferably include deaeration means which allow the solids material to deaereate just prior to entering a variable speed, high pressure solids pump. The deaeration means allows the entrained gas to flow back to the source of the solids, typically a reservoir, via an external conduit. The deaeration means is located just ahead of the pump inlet. Alternatively, some applications will not require a separate deaeration means to accomplish this function; in such cases the solids are self-deaerating, the entrained gases flowing back up to the reservoir through the dense phase discharge conduit itself. The high pressure solids supply system further comprises a variable speed, high pressure solids pump having a pump inlet and a pump outlet, the pump inlet connected to the deaeration means in the discharge conduit. Finally, a feeder tank is connected to the solids pump outlet. The feeder tank is maintained at a higher pressure than the source of solids, and also has an outlet to provide the solids to the process of interest, typically a blast furnace.

Another aspect of the present invention is drawn to a method for continuously conveying solids. The steps of this method include providing a source of solids to a reservoir. The method discharges the solids from the reservoir into a discharge conduit in a dense phase flow. The dense phase flow of solids is deaerated and then enters a variable speed, high pressure solids pump. The solids pump is used to increase the pressure of the solids flow. The dense phase flow of solids is then discharged to a feeder tank which is maintained at a higher pressure than the pressure in the reservoir. The solids in dense phase flow are then provided to an application through an outlet of the feeder tank. The solids pump is controlled such that a substantially constant level of solids is maintained in the feeder tank.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 2:
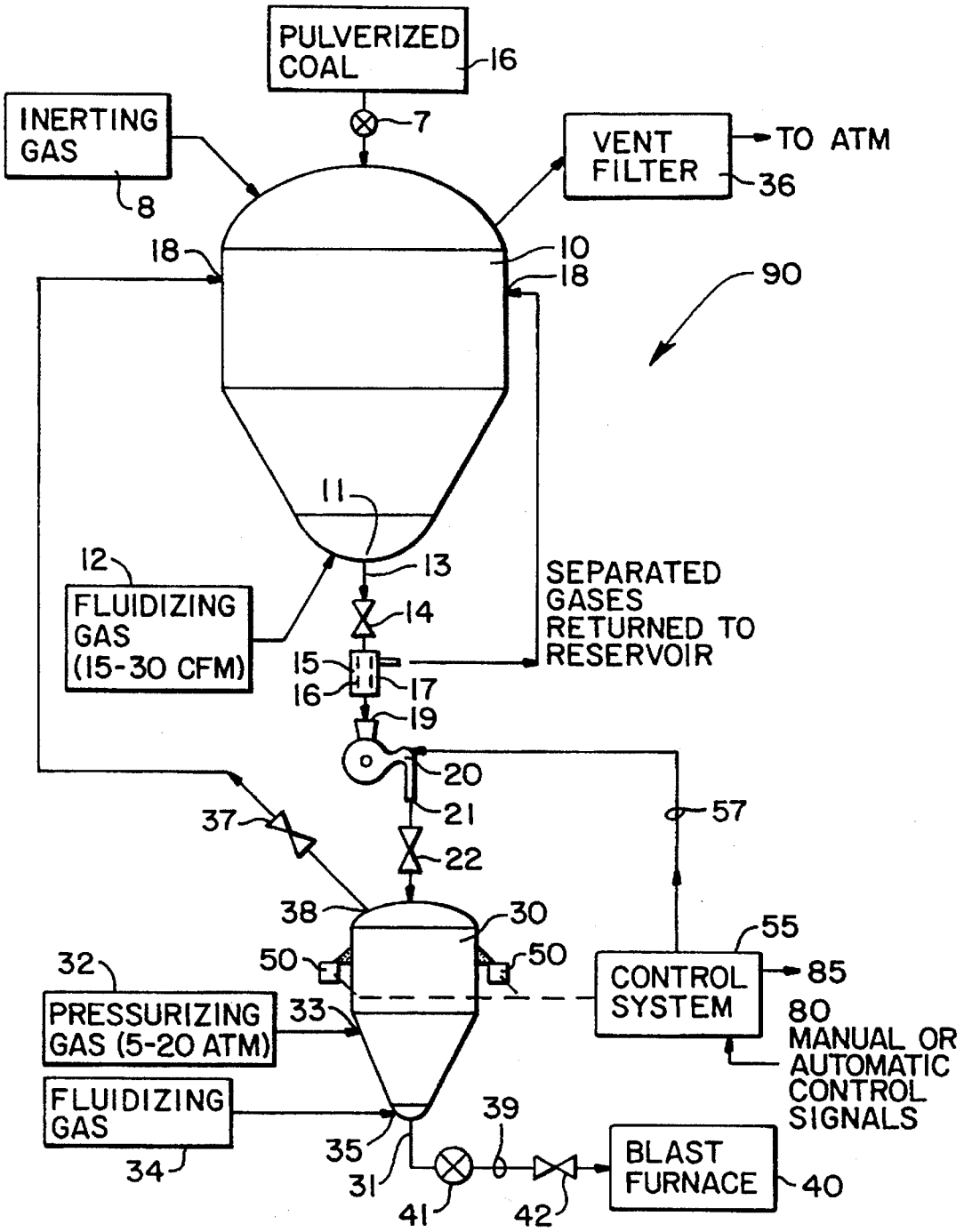
FIG. 2 is a schematic drawing of a first embodiment of the system of the present invention.
Figure 3:
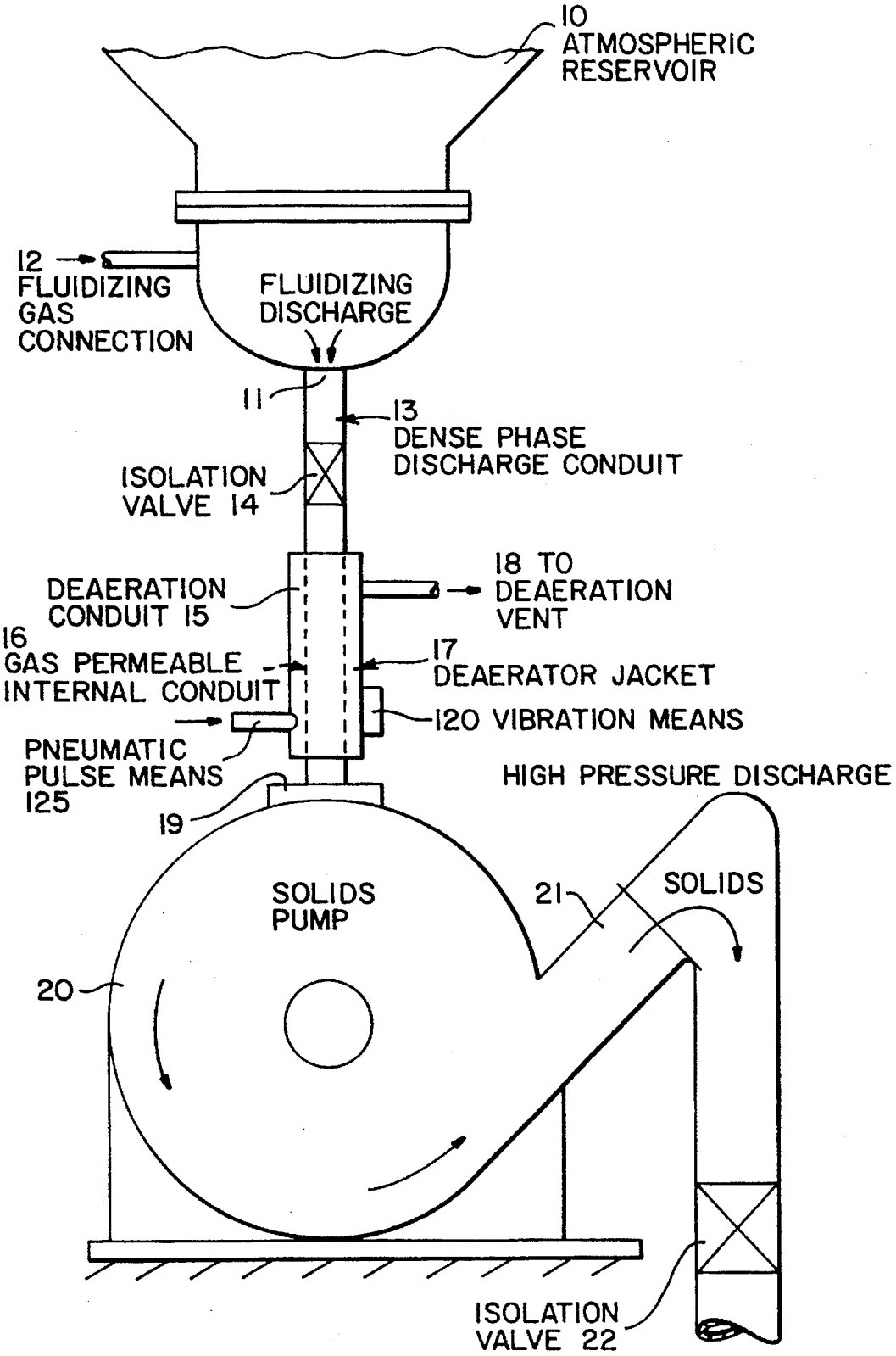
FIG. 3 is a schematic detail drawing of the discharge conduit portion of the system of FIG. 2, illustrating the deaeration means of the present invention in greater detail.

Referring to the drawings generally, wherein like numerals represent the same or functionally similar elements in the drawings, and to FIGS. 2 and. 3 in particular, one aspect of the present invention is drawn to a high pressure solids supply system, generally designated 90. The system 90 has a collection and storage reservoir 10 with reservoir outlet 11. Reservoir outlet 11 provides a dense phase flow of solids, advantageously pulverized coal, into a dense phase discharge conduit 13 which has an isolation valve 14. The solids will eventually be conveyed to a variable speed, high pressure solids pump 20 at pump inlet 19. FIG. 2 further discloses one preferred embodiment of the invention which includes a deaerator means 15 containing a gas permeable internal conduit 16, a deaerator jacket 17 and a vent 18. As shown in greater detail in FIG. 3, since the solids must be fluidized with fluidizing gas 12 to enable them to be discharged from the reservoir 10, the deaeration means 15 is required to maintain proper, deaerated conditions in the solids at the pump 20 inlet so that pump 20 will maintain its seal. The gas permeable internal conduit 16 has a wall which is advantageously made of a fabric filter material, such as Gore Tex® or the like, which will allow the gases to pass therethrough but which will retain the fine solids within the gas permeable conduit 16. Other suitable filter materials could be porous ceramics, metals or polymers. Gases passing through the filter wall of conduit 16 are conveyed into an annular space defined between conduit 16 and jacket 17 and then back into the reservoir 10 at vent 18. Alternatively, the deaerator vent gas may be vented to atmosphere and/or may be induced by a exhauster fan (not shown). The deaerator means 15 may employ a means to stimulate flow and prevent pluggage by applying vibration to the deaerator means 15, as schematically indicated at 120. It may also utilize a pneumatic pulse means 125, for applying a pneumatic pulse inside the deaerator jacket 17 which will stimulate the material flow inside the gas permeable conduit 16.

Referring back to FIG. 2, the storage reservoir 10 is typically maintained at atmospheric or near atmospheric pressure. The storage reservoir 10 may be inerted (such as with nitrogen or $N_2$) from a source 8 of inerting gas or remain uninerted, depending on the combustibility of the fine solids therein. Pump outlet 21 connects to feeder tank 30, which has its outlet 31 connected to discharge line 39. Discharge line 39 is connected to an application such as furnace 40.

Collection and storage reservoir 10 is supplied with solids, such as pulverized coal, from solids source 16. Reservoir 10 has fluidizing gas 12 provided near outlet 11 to fluidize the solids within the reservoir 10 to maintain a dense phase flow through outlet 11 and into the discharge conduit 13. In one embodiment, reservoir 10 may have one or more vent inlets 18 near its top.

As indicated above, the reservoir 10 is usually at atmospheric pressure, and may be filled from solids source 16 by any known means, including but not limited to gravity, a belt type feeder, or a rotary feed pump, all schematically indicated at 7.

Solids pump 20 is preferentially a modified version of a high pressure solids pump available from STAMET, Incorporated, and is capable of transferring and metering solids. For details of the basic solids pump configuration, the reader is referred to the aforementioned U.S. Pat. Nos. 4,516,674; 4,988,239; and 5,051,041 to Firth. Modifications that will be necessary include those needed to operate at the required pressures, and/or to meet safety requirements which may be imposed by local, state, or national codes for materials which have explosive or other hazardous characteristics. The pump 20 also increases the pressure between the reservoir 10 and feeder tank 30, and serves as a pressuring boundary therebetween. Solids pump 20 is powered by a variable speed electric motor (not shown), which may be controlled by known means so that the solids are properly metered into the feeder tank 30 and to keep the feeder tank 30 at a nearly constant fill level.

Metered and pressurized solids leave pump outlet 21 at a higher pressure than in the reservoir 10, are conveyed to pressurized feeder tank 30. The pump 20 is controlled by a control system 55 which varies the speed of the electric motor (not shown) driving solids pump 20, based upon signals indicative of the weight of feeder tank 30 provided by load cells or level sensors schematically indicated at 50. The control system 55 provides a control signal to the electric motor (not shown) via line 57, schematically shown being provided to pump 20 for simplicity. The solids pump 20 is operated in such a manner so as to affect whatever fine solids process flow is discharged from the bottom of the feeder tank 30 via discharge line 39. Manual (via a human operator) or automatic control signals 80 from other systems may also be provided to the control system 55, based upon process conditions, such as those occurring within blast furnace 40. System data signals, schematically represented at 85, can be provided to remote locations to apprise operators of operating conditions.

Feeder tank 30 has outlet 31 at its lower end connected to discharge pipe 39. Fluidizing gas 34 is provided at inlet 35 adjacent feeder tank outlet 31 to ensure that the solids material is in the dense phase flow when it leaves the feeder tank 30. A pressurizing gas 32 is supplied to the tank at pressurizing gas inlet 33, to help maintain the pressure within the feeder tank 30. The pressure within the feeder tank 30 is preferentially between 5 and 20 atmospheres. A vent 38 may be provided near the top of the feeder tank 30 for reducing the pressure within the feeder tank 30. Fluidizing gas 34, pressurizing gas 32 and vent 38 all assist in regulating the flow of dense phase solids through tank outlet 31 and discharge pipe 39.

Feeder tanks 30 may also employ variable speed rotary feeders or similar devices 41 at tank outlet 31 to regulate flow from the tank 30 to the process of interest, as well as isolation valve 42.

Discharge pipe 39 connects the feeder tank outlet 31 to intermediate distribution systems (not shown), when needed, and applications such as blast furnace 40.

Isolation valves 14 and 22 may be provided between reservoir outlet 11 and pump inlet 19, and pump outlet 21 and feeder tank 30, respectively. The isolation valves 14, 22 are useful for keeping the lower pressure reservoir 20 separated from the higher pressure feeder tank during cleaning and maintenance. Vent 38 may be added to feeder tank 30 and can be used to reduce the pressure inside the tank 30. A vent filter 36 is added to the vent line to remove unwanted particles from the vented gases, which can be maintained in the system 90 by returning it to reservoir 10 through inlet 18.

Figure 4:
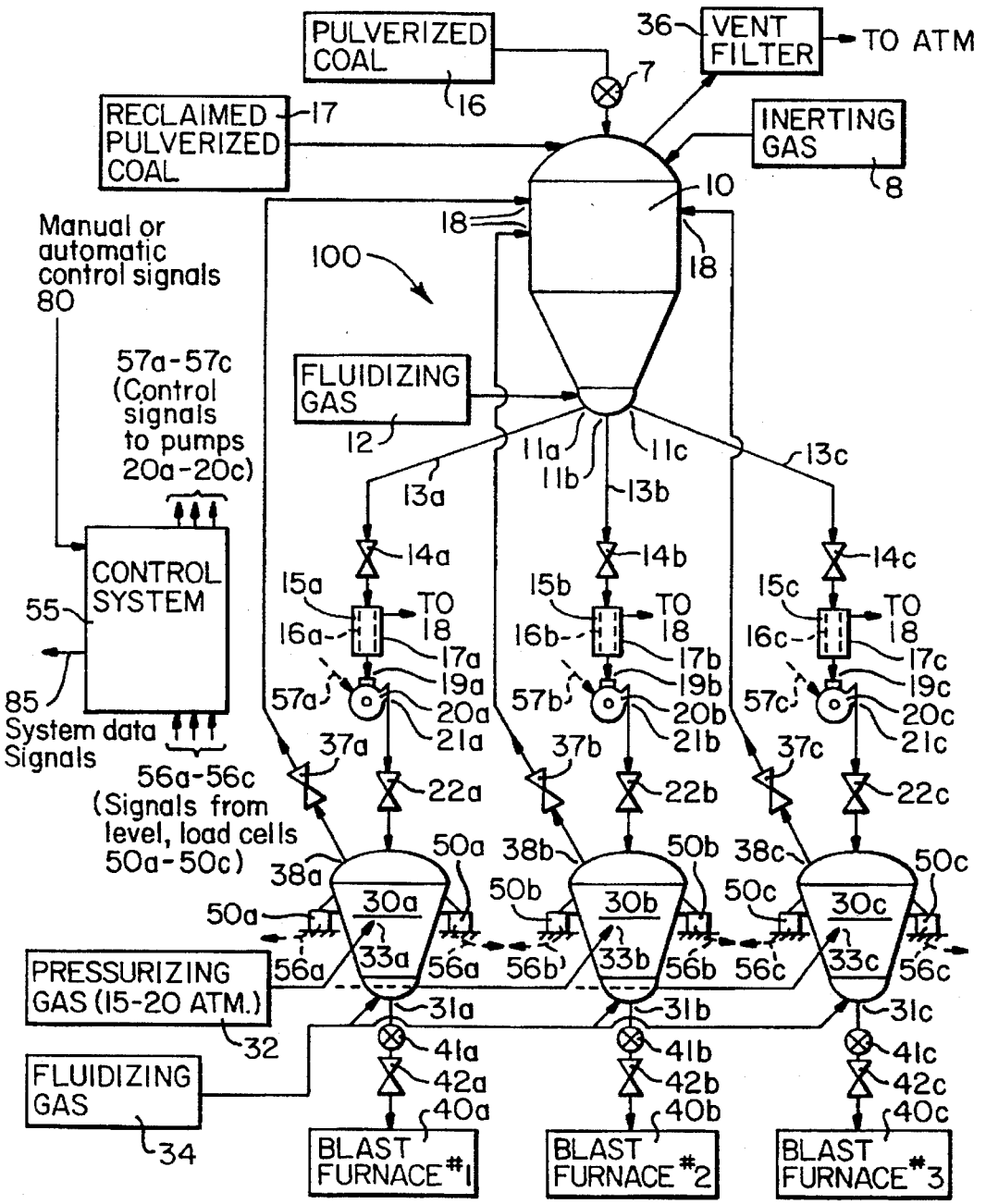
FIG. 4 is a schematic drawing of one application of the present invention wherein one reservoir supplies plural feeder tanks in parallel.
Figure 5A:
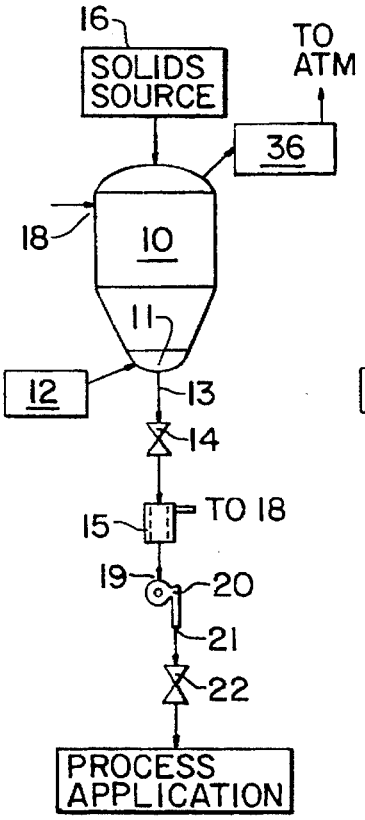
FIGS. 5(*a*)–5(*d*) are schematics of other embodiments of the present invention.
Figure 5B:
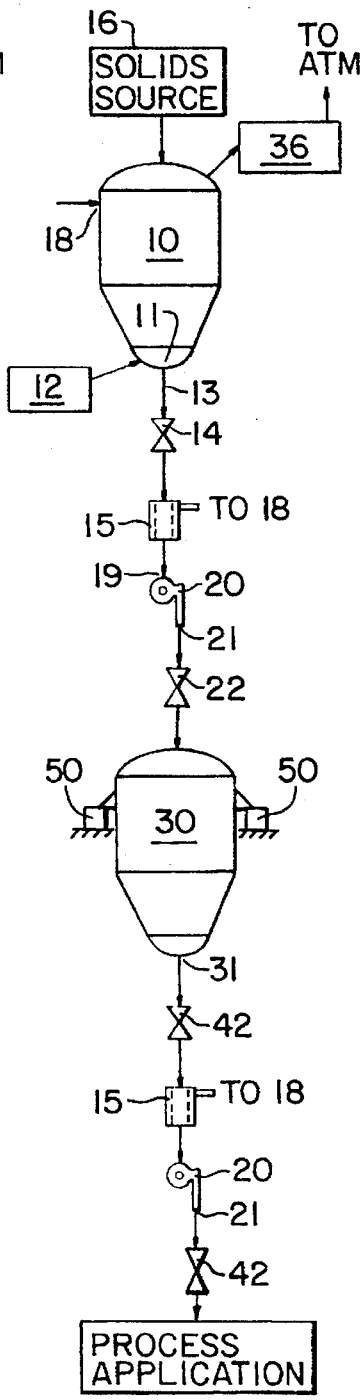
Figure 5C:
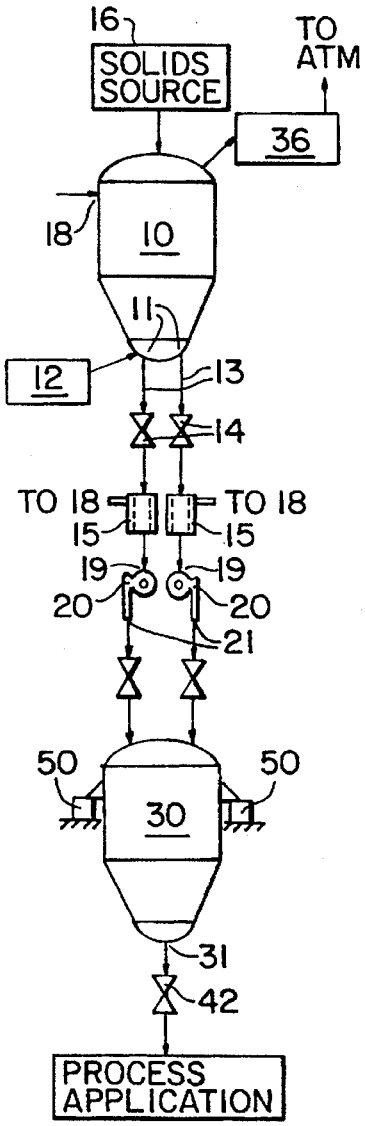
Figure 5D:
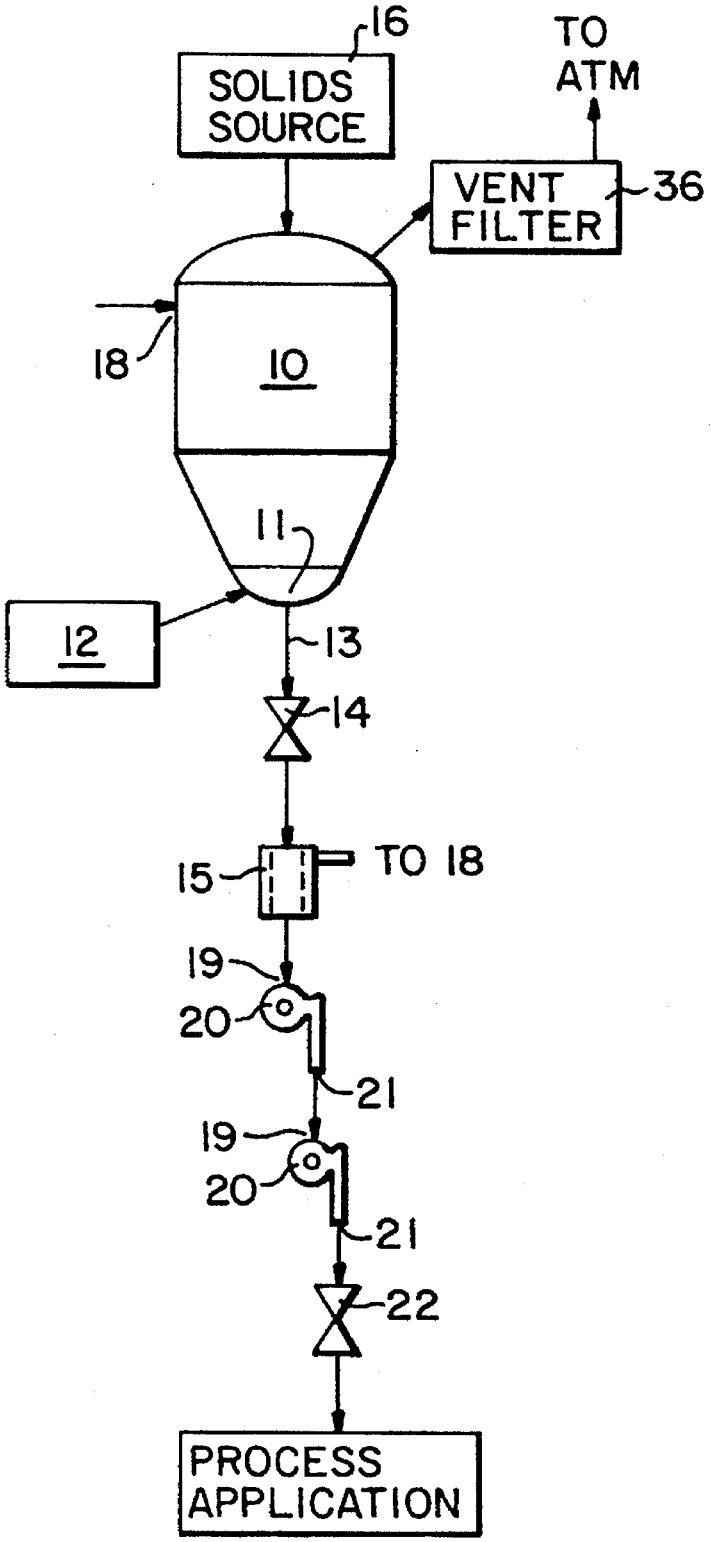

One application of the present invention is shown in furnace supply system 100 of FIG. 4. Supply system 100 has a single reservoir 10 which receives solids in the form of pulverized coal from sources 16 and 17. Coal source 17 includes reclaimed pulverized coal from sources such as baghouse filters and cyclones (not shown). Coal source 16 includes the primary source of pulverized coal such as from a pulverizer or crusher (not shown).

Figure 1:
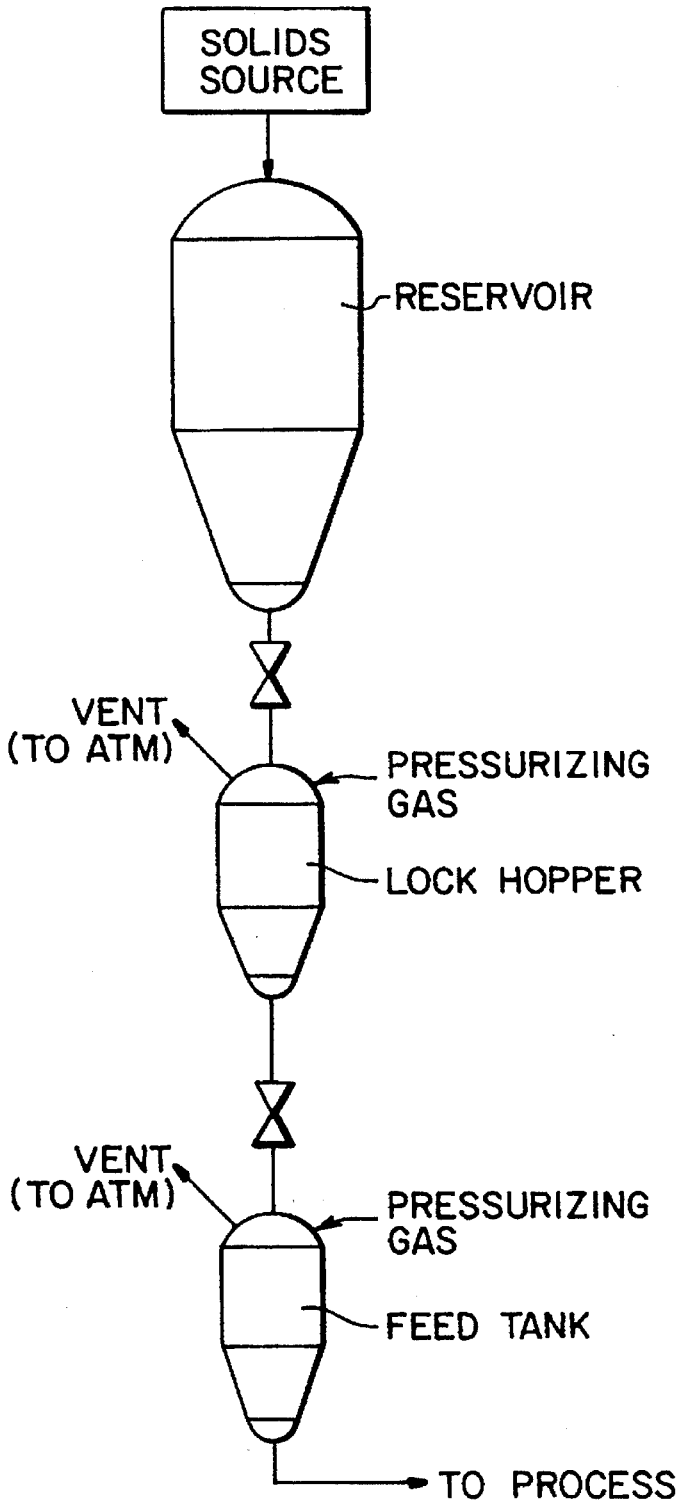
FIG. 1 PRIOR ART
FIG. 1 is a schematic representation of a known series tank arrangement also known as a lock hopper system.

The coal in reservoir 10 is fluidized to a dense phase flow as before by fluidizing gas 12 injected near reservoir multiple outlets 11*a*–11*c*. In this case, three lines are shown, but more are possible if the capacity of the reservoir 10 will allow it, and one line, as shown in FIG. 1, or two are also within the scope of this invention. The remaining elements of the system 100 may be identical, or different, in their requirements and capacities. In this example, the remaining elements in each line are substantially identical, although this is not intended to limit the scope of the invention, as it is the intention of this invention that each line is independent of the others.

From multiple outlets 11*a*–11*c*, the dense phase flow travels through conduits 13*a*–13*c* and isolation valves 14*a*–14*c* to pump inlets 19*a*–19*c*, where variable speed high pressure solids pumps 20*a*–20*c* raise the pressure between reservoir 10 and feeder tanks 30*a*–30*c*. Conduits 13*a*–13*c* are preferably vertical but may be sloped only in that part of the conduit where the material is aerated and flowing in dense phase. Before the solids stream becomes deaerated either by back venting in conduit 13*a*–13*c* or by separate deaerator means 15, the flow must be vertical into the pump inlets 19*a*–19*c*. Pumps 20*a*–20*c* transfer the dense phase flow to the higher pressure region, and eject the flow from pump outlets 21*a*–21*c*, where the flow is conveyed through isolation valves 22*a*–22*c* to feeder tanks 30*a*–30*c*. It should be noted, that as with the system 90 of FIG. 1, the isolation valves 14*a*–14*c* and 22*a*–22*c* are not required for normal operation of the invention, but are used to assist in cleaning and maintenance of the system 100. Each pump 20*a*–20*c* is controlled by control system 55 which varies the speed of the electric motor (not shown) driving each solids pump 20*a*–20*c*, based upon signals indicative of the weight of feeder tank 30*a*–30*c* provided by load cells or level sensors schematically indicated at 50. The control system 55 provides a control signal to each of the electric motors (not shown) via line 57, schematically shown being provided to pumps 20*a*–20*c* for simplicity. Each solids pump 20*a*–20*c* is operated in such a manner so as to affect whatever free solids process flow is discharged from the bottom of each feeder tank 30*a*–30*c* via discharge lines 39*a*–39*c*. Manual (via a human operator) or automatic control signals 80 from other systems may also be provided to the control system 55, based upon process conditions, such as those occurring within blast furnaces 40*a*–40*c*. System data signals, schematically represented at 85, can again be provided to remote locations to provide system status information to the operators.

The pulverized coal that was transported as a dense phase flow to the feeder tanks 30*a*–30*c* is stored until it is again fluidized by fluidizing gas 34, injected near tank outlets 31*a*–31*c* at fluidizing inlets 35*a*–35*c*. While the pulverized coal is in the feeder tanks 30*a*–30*c*, the pressure is maintained in part by pressurizing gas 32, supplied to each feeder tank 30*a*–30*c* at pressurizing gas inlets 33*a*–33*c*. The pressurizing gas 32 may be adjusted for each tank to assist in controlling the flow of pulverized coal leaving the tank. Additionally, as shown in FIG. 2, a single source for each of the fluidizing gas 34 and pressurizing gas 32 may be used in combination with valves (not shown) to control the supply of each gas to the feeder tanks 30*a*–30*c*, or individual sources may be used.

In this system 100, each feeder tank 30 is again provided with a vent 38*a*–38*c*, for removing pressurized gases from the system. Each vent line has an isolation valve 37*a*–37*c* and recycles gases to and terminates at reservoir vent inlet(s) 18. The vents 38*a*–38*c* and associated isolation valves 37*a*–37*c* and lines are not necessarily required in this system 100, and are included for cleaning and maintenance and additional pulverized discharge flow control in the feeder tanks 30*a*–30*c*. A vent filter 36 would typically be provided to reservoir 10, eventually venting to atmosphere (ATM) as shown.

Finally, each feeder tank 30*a*–30*c* is used to supply a discharge line 39*a*–39*c* which is connected to an application, in this case three blast furnaces 40*a*–40*c*. These furnaces may be separate furnaces, or the discharge lines may connect the pulverized coal supply of two or more feeders 30*a*–30*c* to different combustion areas of the same furnace 40*a*–40*c*. An isolation valve 42*a*–42*c* is provided in each discharge line 39*a*–39*c* to shut off the flow of dense phase pulverized coal to the furnaces 40*a*–40*c* if necessary, but the valves 42*a*–42*c* are not required for operation. Again, a rotary valve means 41*a*–41*c* may also be provided if needed.

There are three primary advantages of this invention vis-a-vis the classic batch type or lock hopper feed system:

1. The continuous pump system eliminates the cycling of multiple batch tanks and their associated fill valves, pressurizing valves, on-line dense phase flow valves and vent valves. These valves are typically severe duty valves which require significant maintenance.
2. The continuous pump system eliminates the disruption in solids feed which occurs in a batch tank system when one tank goes off line and another comes on line. Also, because the continuous feed system maintains a constant fine solids inventory in the feed tank, there is no feed rate change which may occur in a batch tank whose inventory is reduced from full to near-empty during a feed cycle.
3. The continuous pump system eliminates the venting of significant quantities of pressurized gas which occurs at the end of a batch tank feed cycle or a lock hopper charge cycle. This vented gas wastes the energy of compression normally supplied by motor driven compressors and the value of the gas itself if it is vented to an atmospheric discharge point. It also eliminates the need for large vent filters and their associated installation, operation, and maintenance costs.

The continuous pump system of the present invention also has two major advantages over the cascading pressure continuous blow bottle system of U.S. Pat. No. 5,265,983 to Wennerstrom et al.:

1. The multiple rotary feeders employed by the continuous blow bottle must each be vented to prevent blowback of pressurized gases coming from the pressurized feed tank (blow bottle). This gas has a compression energy component which is lost and may discard gas which has some value as in Item 3 above.

2. The rotary feeders that are employed by the continuous blow bottle have relatively low differential pressure capability when compared to the solids pump. Hence, multiple or cascading rotary feeders are needed for higher pressure systems which complicates the system, adds initial cost and increases operation and maintenance costs.

While specific embodiments of the invention have been shown and described in detail to illustrate the application of the principles of the invention, it will be understood that the invention may be embodied otherwise without departing from such principles. For example, while the present invention is particularly suitable as part of a pulverized fuel delivery system for blast furnaces used in the manufacture of iron and steel, it could also be used to transport such fuels to other types of furnaces, for other purposes. Similarly, the solids material need not be a fuel, but instead could be other types of pulverized material that needs to be transported from a region of atmospheric pressure to another region at superatmospheric pressure. Several alternative arrangements of the present invention using the high pressure free solids pump could accomplish the purpose intended:

1. An arrangement without the pressurized feed tank. The solids pump would discharge directly into a high pressure conduit for fluidization and conveying to the process.
2. An arrangement that contains two high pressure fine solids pumps, one upstream of the high pressure feed tank and one at the feed tank outlet. This outlet pump would take the place of feed tank pressurizing gas as the means to regulate flow out of the feed tank and into the process.
3. An arrangement that contains two or more solids pumps in parallel between a single storage bin or reservoir and a single pressurized feed tank. This arrangement would allow for greater capacity or for redundancy in case of a pump failure.
4. An arrangement that contains two or more pumps in series for cases where one pump cannot achieve the pressure rise required by the system. Pumps in series would be in a cascade scheme, each delivering fine solids at higher pressure to the next pump.
5. Any combination of storage bins pumps and pressurized feed tanks that are appropriate for the process requirements. For instance, in the case of blast furnace pulverized coal injection, a single large pulverized coal bin could be utilized for the injection of coal into multiple furnaces by using multiple solids pumps and pressurized feed tanks arranged in parallel under the storage bin.

These various alternative arrangements are shown schematically in FIGS. 5(*a*)–5(*d*). Like numerals designate the same or functionally similar elements. Since the particular functions and details have thus been mentioned previously, a detailed description of such modifications have been omitted herein for the sake of conciseness and readability, but properly fall within the scope and equivalents of the following claims.

We claim:

1. A continuous high pressure solids supply system comprising:

a source of solids;

fluidizing means for discharging the solids in a dense phase flow;

deaerating means for deaerating the solids flow prior to entering a solids pump;

a variable speed, high pressure solids pump having a pump inlet and a pump outlet, the pump inlet connected to the deaerating means; and a feeder tank connected to the solids pump outlet, the feeder tank at a higher pressure than the source of solids, and having an outlet.

2. The continuous high pressure solids supply system according to claim 1, further comprising means for supplying the solids in a dense phase flow at high pressure from the feeder tank outlet to an application.

3. The continuous high pressure solids supply system according to claim 2, further comprising at least one isolation valve located at at least one of between the source of solids and the solids pump inlet and between the solids pump outlet and the feeder tank.

4. The continuous high pressure solids supply system according to claim 3, wherein the solids comprises pulverized coal, and the source of solids further comprises a pulverizer.

5. The continuous high pressure solids supply system according to claim 4, wherein the application comprises a furnace.

6. The continuous high pressure solids supply system according to claim 2, further comprising control means for maintaining a substantially constant level of solids in the feeder tank.

7. The continuous high pressure solids supply system according to claim 6, wherein the solids comprises pulverized coal, and the source of solids further comprises a pulverizer.

8. The continuous high pressure solids supply system according to claim 7, wherein the application comprises a furnace.

9. The continuous high pressure solids supply system according to claim 1, further comprising a second solids feed pump located at the outlet of the feeder tank.

10. The continuous high pressure solids supply system according to claim 1, further comprising two or more solids pumps in parallel between the source of solids and the feeder tank.

11. The continuous high pressure solids supply system according to claim 1, further comprising two or more solids pumps in series between the source of solids and the feeder tank.

12. The continuous high pressure solids supply system according to claim 1, further comprising vibration means operatively associated with the deaerator means to stimulate flow and prevent pluggage therein.

13. The continuous high pressure solids supply system according to claim 1, further comprising pneumatic pulse means operatively associated with the deaerator means for supply a pneumatic pulse inside a jacket of the deaerator means to stimulate flow and prevent pluggage therein.

14. A continuous high pressure solids supply system comprising:

a source of solids;

fluidizing means for discharging the solids in a dense phase flow;

deaerating means for deaerating the solids flow prior to entering a solids pump;

a variable speed, high pressure solids pump having a pump inlet and a pump outlet, the pump inlet connected to the deaerating means; and means for conveying solids from the pump outlet to an application.

15. The continuous high pressure solids supply system according to claim 14, further comprising two or more solids pumps in parallel between the source of solids and the application.

16. The continuous high pressure solids supply system according to claim 14, further comprising two or more solids pumps in series between the source of solids and the application.

17. A method for continuously conveying solids, comprising:

providing a source of solids to a reservoir;

fluidizing the solids in the reservoir to produce a dense phase flow;

deaerating the dense phase flow of solids prior to providing same to a variable speed, high pressure solids pump;

using said solids pump to increase the pressure of the dense phase flow;

transporting the dense phase flow of solids to a feeder tank maintained at a higher pressure than a pressure in said reservoir;

providing the solids in dense phase flow to an application through an outlet of the feeder tank; and controlling the solids pump such that a substantially constant level of solids is maintained in the feeder tank.

18. The method for continuously conveying solids according to claim 17, wherein the solids comprises pulverized coal.

19. The method for continuously conveying solids according to claim 17, wherein the application comprises a furnace.

* * * * *